US006591951B1

(12) United States Patent
Chen

(10) Patent No.: US 6,591,951 B1
(45) Date of Patent: Jul. 15, 2003

(54) ADJUSTMENT STRUCTURE OF A HAND GRIP OF A PULL ROD

(76) Inventor: Shou-Mao Chen, 344, Sec. 1, Chung Shan Rd., Tah-Cha Township, Taichung Hsien (TW)

( * ) Notice: Subject to any disclaimer, the term of this patent is extended or adjusted under 35 U.S.C. 154(b) by 0 days.

(21) Appl. No.: 10/059,062

(22) Filed: Jan. 30, 2002

(51) Int. Cl.[7] ..... A45C 13/00
(52) U.S. Cl. ..... 190/115; 16/113.1
(58) Field of Search ..... 190/115, 18 A; 16/113.1; 280/47.315, 37, 655

(56) References Cited

U.S. PATENT DOCUMENTS 5,353,900 A * 10/1994 Stilley ..... 190/18 A
5,370,409 A * 12/1994 Latouche ..... 16/113.1 X
5,464,080 A * 11/1995 Liang ..... 190/18 A
5,813,504 A * 9/1998 Iny et al. ..... 190/115 X
6,122,800 A * 9/2000 Cheng ..... 16/113.1
6,279,706 B1 * 8/2001 Mao ..... 16/113.1 X
6,434,790 B1 * 8/2002 Chen ..... 16/113.1
6,464,245 B1 * 10/2002 Miles ..... 16/113.1 X

* cited by examiner

*Primary Examiner*—Tri M. Mai
(74) *Attorney, Agent, or Firm*—Harrison & Egbert

(57) ABSTRACT

A hand grip is fastened to the top end of a pull rod in conjunction with an adjustment structure which enables the hand grip to be adjusted in angle in relation to the top end of the pull rod. The adjustment structure includes a shaft and a locating seat. The hand grip can be adjusted in angle at the time when a bearing block of the shaft is disengaged from a retaining hole of the locating seat.

1 Claim, 7 Drawing Sheets

ADJUSTMENT STRUCTURE OF A HAND GRIP OF A PULL ROD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pull rod, and more particularly to an adjustment structure of a hand grip of the pull rod.

BACKGROUND OF THE INVENTION

The conventional baggages are generally provided with a pull rod which is in turn provided at the top end with a hand grip. The hand grip is fixed with the pull rod and is therefore not adjustable in angel. The fixed hand grip makes it difficult for the user of the baggage to pull the baggage on the surface.

BRIEF SUMMARY OF THE INVENTION

The primary objective of the present invention is to provide a pull rod with an adjustable hand grip.

In keeping with the principle of the present invention, the foregoing objective of the present invention is achieved by an adjustment structure, which is disposed between the top end of a pull rod and a hand grip. The adjustment structure enables the hand grip to turn an angle in relation to the pull rod.

The features and the advantages of the present invention will be more readily understood upon a thoughtful deliberation of the following detailed description of the present invention with reference to the accompanying drawings.

DETAILED DESCRIPTION OF THE INVENTION

Figure 1:
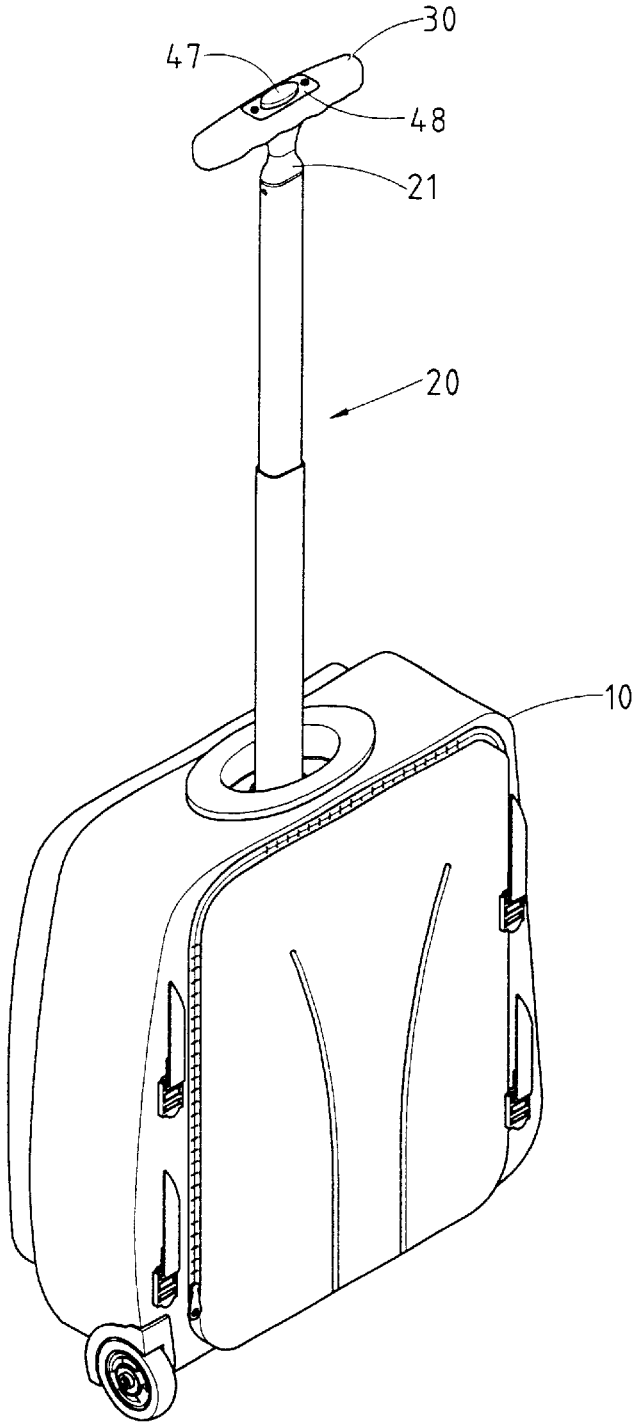
FIG. 1 shows a perspective view of a hand grip of the present invention along with a baggage pull rod.
Figure 2:
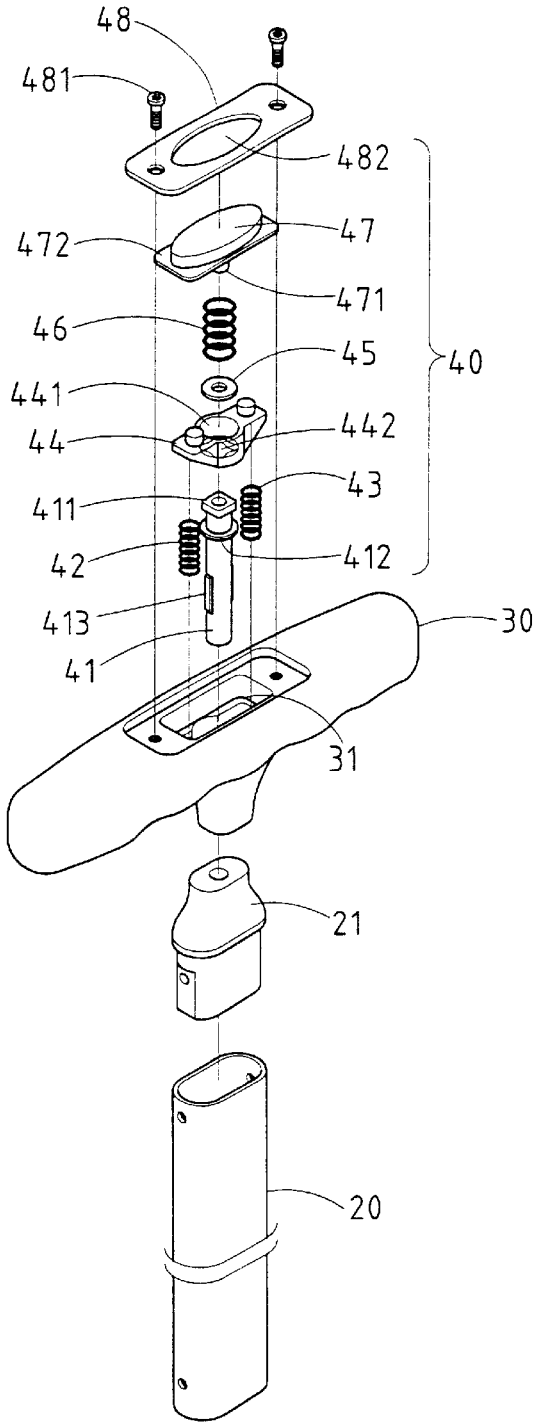
FIG. 2 shows an exploded schematic view of the present invention.
Figure 3:
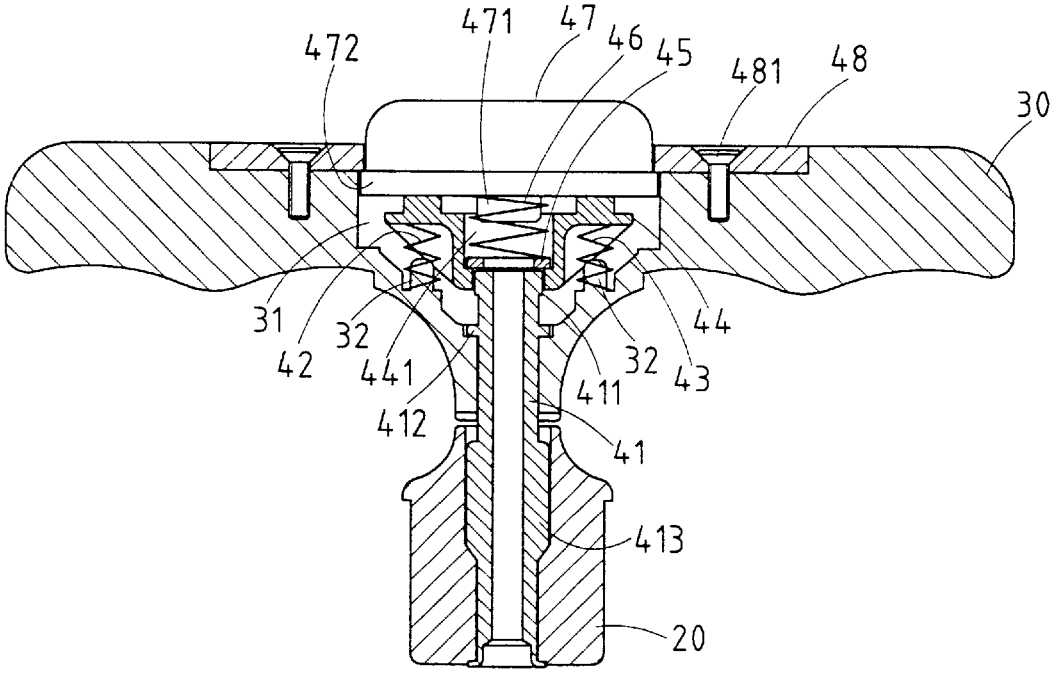
FIG. 3 shows a sectional view of the present invention.
Figure 4:
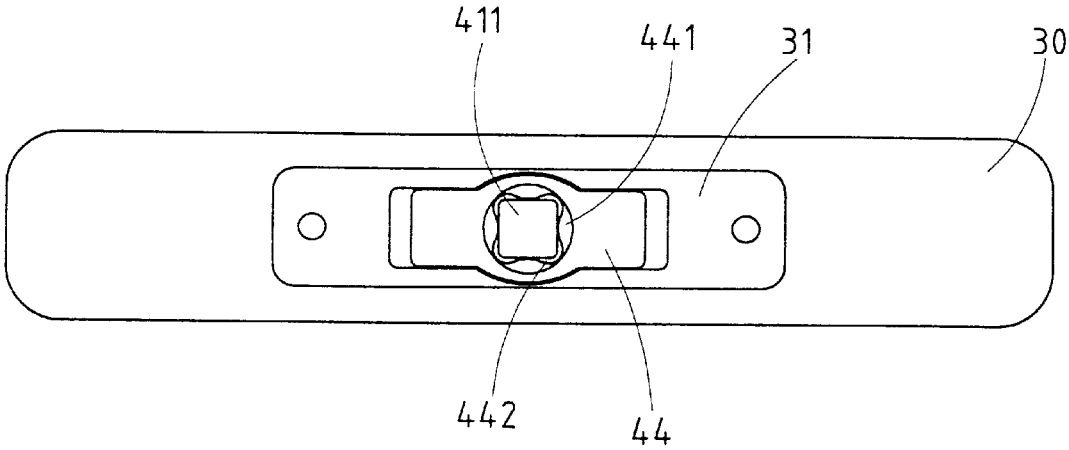
FIG. 4 shows a top plan view of the present invention with the top cover, the press knob and the upper spring thereof being removed.

As shown in FIGS. 1–7, a baggage 10 is provided with an expandable pull rod 20, which is provided at the top end with a seat body 21 for pivoting a hand grip 30 in conjunction with an adjustment device 40 serving to enable the hand grip 30 to be adjusted in angle. The adjustment device 40 is disposed in the interior of the hand grip 30 and is formed of a shaft 41, two lower springs 42, 43, a locating seat 44, a washer 45, an upper spring 46, a press knob 47, and a top cover 48.

The shaft 41 is provided at the top end with an enlarged bearing block 411, a flange 412, two protruded ribs 413 opposite to each other. The shaft 41 is disposed in a receiving slot 31 of the hand grip 30 such that the bottom end of the shaft 41 is fastened with the seat body 21 of the top end of the pull rod 20, and that the flange 412 of the shaft 41 is located under the bottom end of the receiving slot 31 of the hand grip 30.

The two lower springs 42 and 43 are fitted over two pillars 32 of the receiving slot 31 of the hand grip 30.

The locating seat 44 is provided with a round slot 441 which is in turn provided in the bottom wall with a retaining hole 442 dimensioned and shaped to allow the passage of the bearing block 411 of the shaft 41. The locating seat 44 is disposed in the receiving slot 31 of the hand grip 30 such that the underside of the locating seat 44 is urged by the top ends of the two lower springs 42 and 43, and that the retaining hole 442 of the locating seat 44 is joined with the bearing block 411 of the shaft 41.

The washer 45 is received in the round slot 441 of the locating seat 44.

The upper spring 46 is disposed in the round slot 441 of the locating seat 44 such that a top end of the upper spring 46 juts out of the top of the locating seat 44.

The press knob 47 is provided at the center of the underside thereof with a projection 471 and is disposed in the receiving slot 31 of the hand grip 30 such that the projection 471 of the press knob 47 is fitted into the top end of the upper spring 46, and that the underside of the press knob 47 is rested on the top surface of the locating seat 44.

The top cover 48 is fastened with the top surface of the hand grip 30 by a plurality of fastening screws 481. The top cover 48 is provided in the center with a through hole 482 via which the press knob 47 is jutted out such that a stop piece 472 of the press knob 47 is pressed against the underside of the top cover 48.

Figure 5:
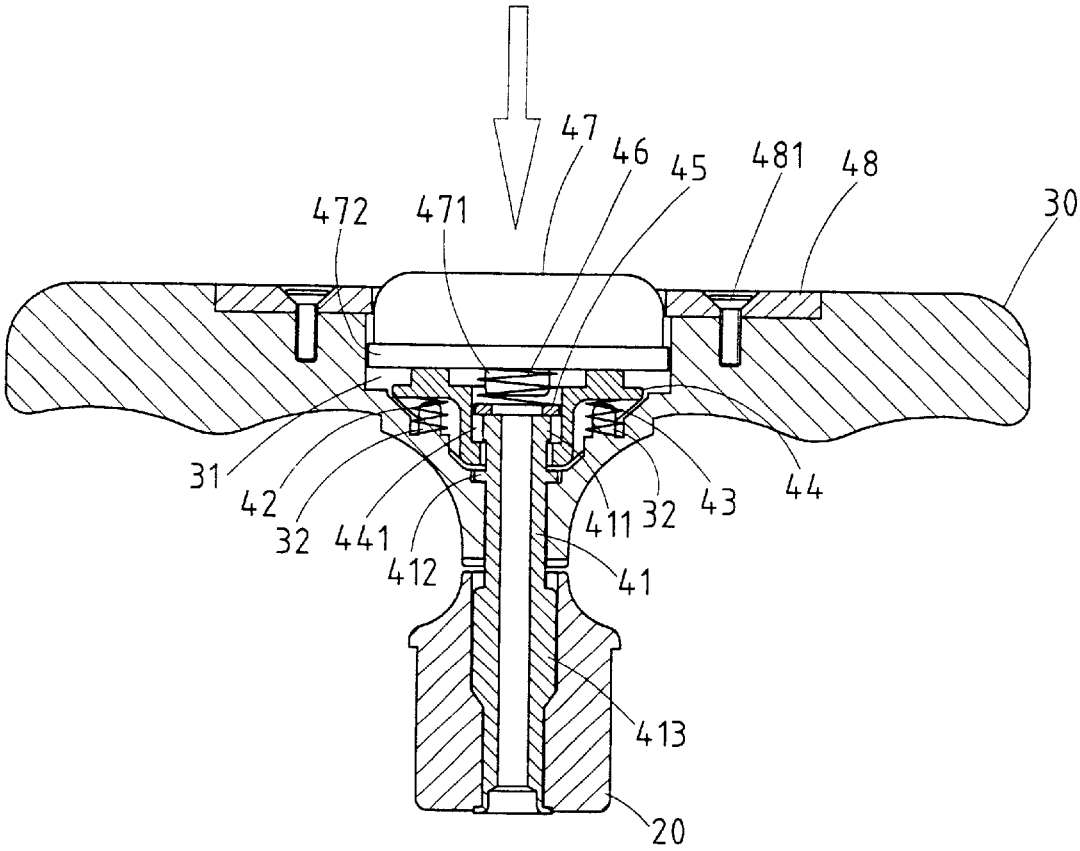
FIG. 5 shows a sectional schematic view of the present invention with the press knob thereof being pressed.
Figure 6:
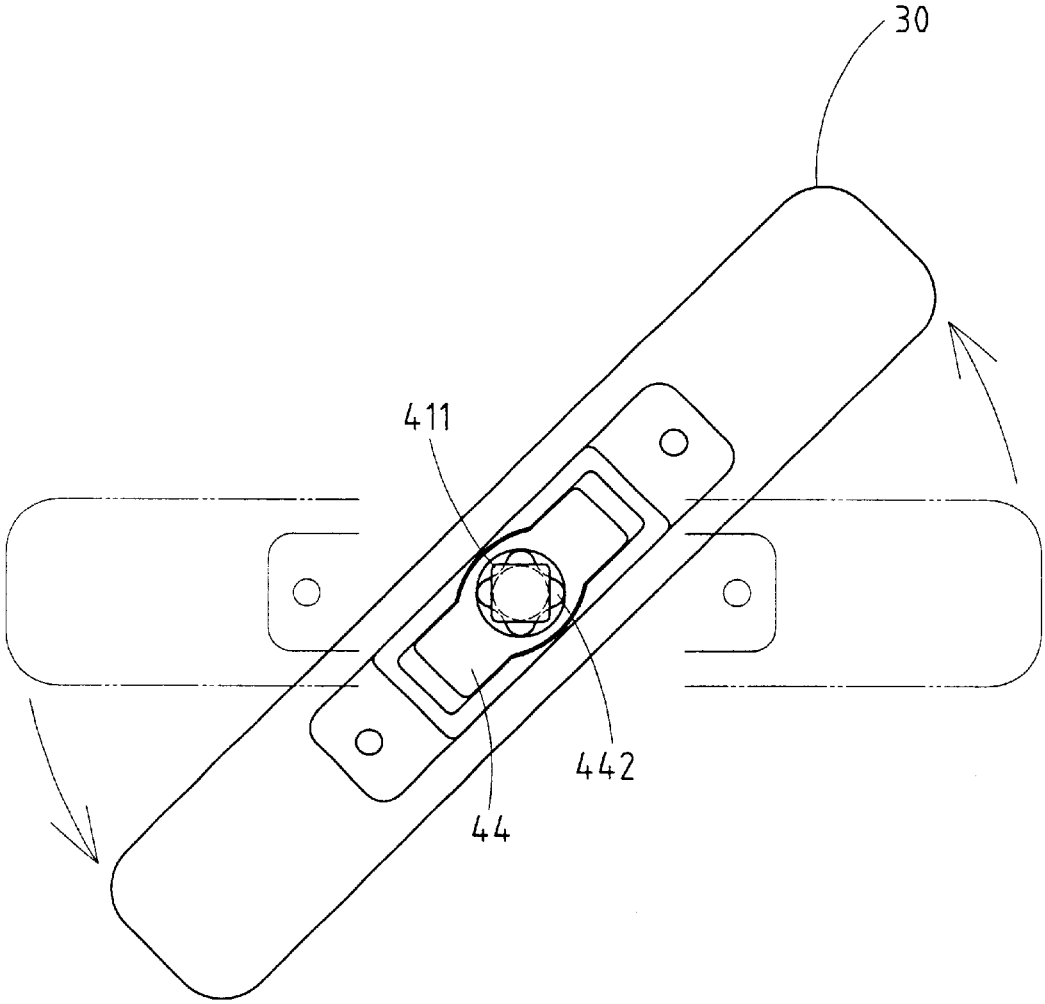
FIG. 6 shows a top plan view of the angular adjustment of the hand grip of the present invention.
Figure 7:
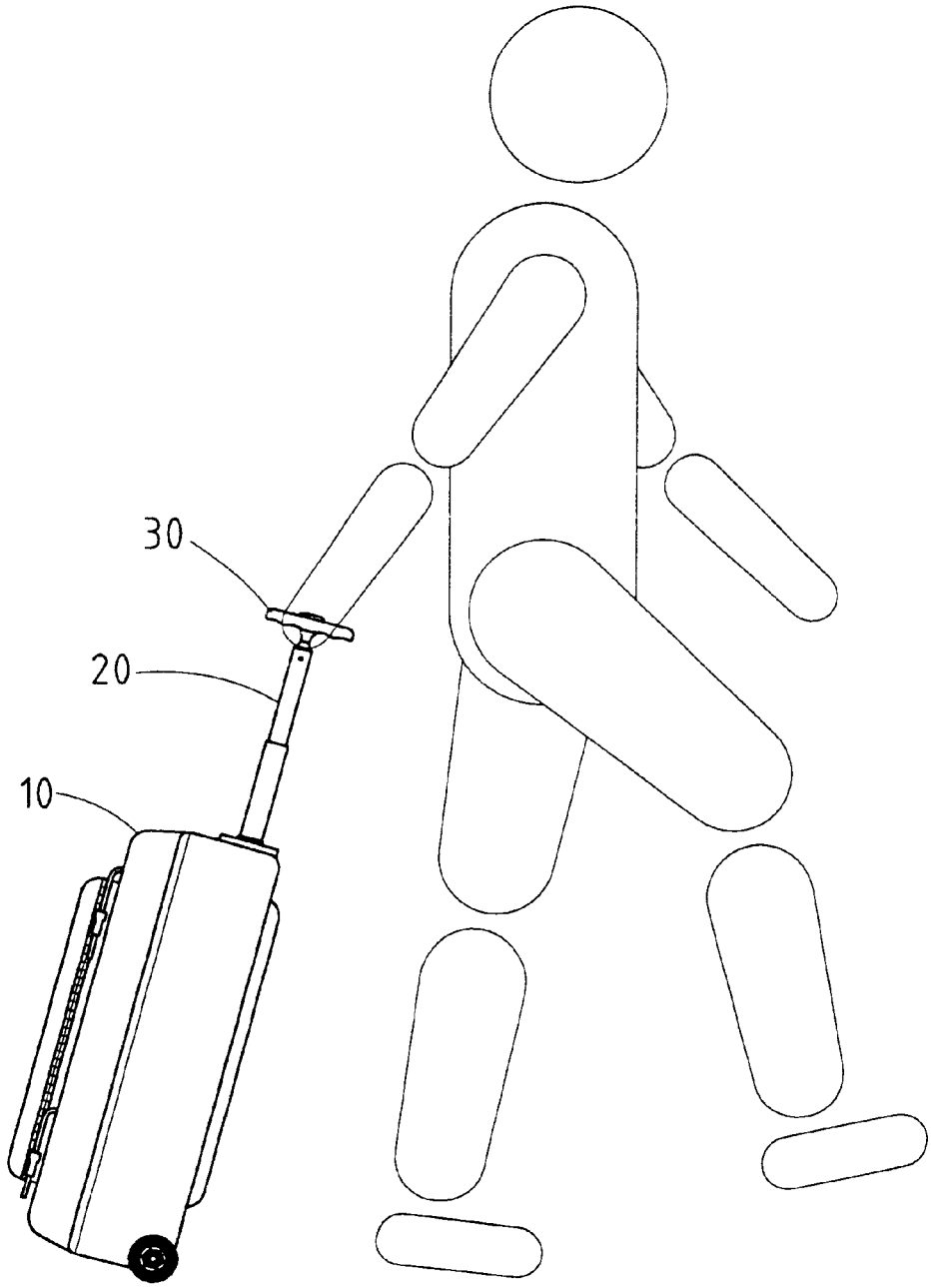
FIG. 7 shows a schematic view of the present invention at work.

As illustrated in FIGS. 5, 6, and 7, prior to the adjusting of the hand grip 30, the press-knob 47 is first pressed so as to compress the upper spring 46 and to put a downward pressure on the locating seat 44. In the meantime, the two lower springs 42 and 43 are compressed by the underside of the locating seat 44. In light of the downward displacement of the locating seat 44, the retaining hole 442 of the locating seat 44 moves away from the bearing block 411 of the shaft 41, thereby enabling the hand grip 30 to be adjusted in angle. As the press knob 47 is let go, the locating seat 44 is forced upwards by the recovery spring forces of the two lower springs 42 and 43 such that the retaining hole 442 of the locating seat 442 is once again joined with the bearing block 411 of the shaft 41.

I claim:

1. An adjustment structure of a hand grip of a pull rod, said adjustment structure being disposed in an interior of said hand grip such that said adjustment structure is fastened with atop end of the pull rod, said adjustment structure comprising:

a seat body mounted at the top end of the pull rod;

a receiving slot located in the interior of the hand grip; and an adjustment device comprising:

a shaft comprised of a bearing block, a flange, and disposed in said receiving slot of the hand grip such that a bottom end of said shaft is fastened to said seat body at top end of the pull rod, and such that said flange is located under a bottom end of said receiving slot of the hand grip;

two lower springs fitted over respectively two pillars of said receiving slot of the hand grip;

a locating seat comprised of a round slot, said round slot has a retaining hole at a bottom wall thereof, said retaining hole is dimensioned and shaped to allow said bearing block of said shaft to pass therethrough, said locating seat being disposed in said receiving slot of the hand grip such that an underside of said locating seat is urged by said two lower springs, and such that said retaining hole of said locating seat is joined with said bearing block of said shaft;

a washer disposed in said round slot of said locating seat;

an upper spring disposed in said round slot of said locating seat such that a top end of said upper spring juts out of a top of said locating seat;

a press knob provided in an underside thereof with a projection and disposed in said receiving slot of the hand grip such that said projection is fitted into the top end of said upper spring, and that the underside of the press knob is rested on the top of said locating seat; and a top cover comprised of a through hole and fastened to the hand grip such that a stop piece of said press knob is pressed against an underside of said top cover, and that said press knob juts out of said top cover via said through hole of said top cover;

said upper spring being compressed by said press knob such that when said press knob is exerted on by an external force, thereby causing said locating seat to displace downward causing said locating seat to compress said two lower springs, and that said retaining hole of said locating seat moves away from said bearing block of said shaft, thereby enabling the hand grip to be turned at an angle, and the hand grip is remained at said angle by relieving said press knob of the external force exerting thereon causing said locating seat to displace upward by the spring forces of said two lower springs such that said retaining hole of said locating seat is once again joined with said bearing block of said shaft.

* * * * *